US009062877B2

(12) United States Patent
Chen

(10) Patent No.: US 9,062,877 B2
(45) Date of Patent: Jun. 23, 2015

(54) FURNACE TUBE ARRANGEMENT FOR STEAM GENERATOR

(75) Inventor: Chao Hui Chen, Crawley (GB)

(73) Assignee: DOOSAN BABCOCK LIMITED, Sussex (GB)

( * ) Notice: Subject to any disclaimer, the term of this patent is extended or adjusted under 35 U.S.C. 154(b) by 222 days.

(21) Appl. No.: 13/703,091

(22) PCT Filed: Jul. 21, 2011

(86) PCT No.: PCT/GB2011/051382

§ 371 (c)(1),
(2), (4) Date: Feb. 12, 2013

(87) PCT Pub. No.: WO2012/013958

PCT Pub. Date: Feb. 2, 2012

(65) Prior Publication Data

US 2013/0233255 A1 Sep. 12, 2013

(30) Foreign Application Priority Data

Jul. 26, 2010 (GB) ..... 1012461.8

(51) Int. Cl.

| | |
|---|---|
| ***F22B 37/10*** | (2006.01) |
| ***F22B 29/06*** | (2006.01) |
| ***F22B 21/34*** | (2006.01) |
| ***F22B 37/14*** | (2006.01) |

(52) U.S. Cl.

CPC ..... *F22B 29/06* (2013.01); *F22B 21/341* (2013.01); *F22B 29/062* (2013.01); *F22B 37/103* (2013.01); *F22B 37/147* (2013.01); *F22B 21/34* (2013.01)

(58) Field of Classification Search

CPC ..... F23D 2900/21001; F23D 29/062; F23D 21/34; F23D 29/061

USPC ..... 122/235.32, 240.1, 334, 336, 510, 511, 122/512, 498, 235.12, 235.11

See application file for complete search history.

(56) References Cited

U.S. PATENT DOCUMENTS

| | | | | | |
|---|---|---|---|---|---|
| 1,936,161 | A | * | 11/1933 | Hedrich | 122/4 R |
| 2,242,491 | A | * | 5/1941 | Van Brunt et al. | 122/235.11 |
| 3,892,191 | A | * | 7/1975 | Welden et al. | 110/205 |
| 3,909,184 | A | * | 9/1975 | Earl | 431/75 |
| 4,294,200 | A | | 10/1981 | Gorzegno | |
| 4,347,810 | A | * | 9/1982 | Rees | 122/6 A |
| 4,394,849 | A | * | 7/1983 | Pratt et al. | 122/235.12 |
| 4,818,252 | A | * | 4/1989 | Kohnen et al. | 48/67 |
| 5,101,773 | A | * | 4/1992 | White | 122/235.13 |
| 5,273,003 | A | * | 12/1993 | Rothwell | 122/235.28 |
| 5,560,322 | A | * | 10/1996 | Fitzgerald | 122/64 |
| 2011/0076630 | A1 | * | 3/2011 | Jameel | 431/181 |

FOREIGN PATENT DOCUMENTS

| | | |
|---|---|---|
| EP | 0 981 017 A2 | 2/2000 |
| GB | 2 103 770 A | 2/1983 |
| JP | 10026305 | 1/1998 |

* cited by examiner

*Primary Examiner* — Gregory A Wilson
(74) *Attorney, Agent, or Firm* — Sughrue Mion, PLLC

(57) ABSTRACT

A furnace tube arrangement for a steam generator is provided. A plurality of furnace tubes disposed longitudinally form a generally planar wall structure into which burner throats are let at least two longitudinally spaced levels in familiar manner. Burner throats at the respective levels are so disposed that a vertical mid-line of each throat at a first level is laterally offset from a vertical mid line of a corresponding throat at a second level.

19 Claims, 3 Drawing Sheets

FURNACE TUBE ARRANGEMENT FOR STEAM GENERATOR

The invention relates to a furnace tube arrangement for a steam generator. The invention in particular relates to a steam generator for once-through or continuous-flow operation, in which a furnace wall comprises furnace tubes arranged longitudinally in parallel in a furnace wall direction (and usually disposed vertically) which are connected together in gas-tight manner via tube webs, and along which an evaporatable flow medium (for example water/steam) can flow in a furnace wall direction (and for example from the bottom to the top).

The invention in particular relates to a steam generator in a thermal power plant which is fired by a plural array of burners for carbonaceous fossil fuels, including solids and especially pulverized solids, liquids, emulsions and gases.

In a once-through steam generator the heating of furnace tubes forming the combustion chamber walls leads to a complete evaporation of the flow medium in the tubes in a single pass. A once-through steam generator may have vertically or spirally disposed furnace tubes, but a vertical tube steam generator is often preferred as generally of simpler construction and as exhibiting lower water-side/steam-side pressure losses than a steam generator with spiral tubes. However, this can lead to problems associated with the varied thermal profile experienced by tubes in the vicinity of the burner throats in the furnace wall.

The tube arrangement in a vertical tube steam generator comprises a plurality of generally straight vertical tubes. In a typical case, a plurality of parallel tubes are connected together in gas-tight manner via tube webs to define a furnace wall and a plurality of such walls define a combustion chamber of polygonal and for example rectangular cross-section. Flow medium flows from one end to the other, for example vertically from bottom to top. Burners fire the combustion chamber through burner throats let into the furnace wall, typically in plural transverse array around the wall at at least two longitudinally spaced levels.

Most of the tubes lie on the inner furnace wall, extend vertically, and carry vertical load. However tubes in the vicinity of a burner throat will need to deviate from the vertical to accommodate the burner throat opening through which the burner fires the combustion chamber.

Thus, the furnace tubes forming the burner throats are longer than the other straight tubes and this affects flow conditions within them. As they deviate from the vertical they do not effectively carry vertical load. Moreover, some burner throat tubes are not only longer but also exposed more extensively to the flame radiation. However, the extent of this exposure varies in different regions of the throat and its vicinity.

A typical burner throat configuration is shown on FIG. 1. A perspective view is given in FIG. 1*a* and a cross-section through a horizontal mid-line axis x is shown in FIG. 1*b*.

As will be familiar, a furnace wall 4 which forms a wall of a combustion chamber carries plural parallel generally vertical furnace tubes. The furnace tubes carry an evaporatable flow medium (for example water/steam) that flows from the bottom to the top. A once-through system is illustrated based on the design principle that leads to a complete evaporation of the flow medium takes place in the tubes in a single pass.

As will be familiar, burner throats to accommodate burners that fire the combustion chamber are let into the wall. FIG. 1 illustrates the tube arrangement in the vicinity of a single such burner throat 22. Vertical tubes in the vicinity of the burner throat 22 pass around or into the throat to accommodate the throat aperture. The burner midline is represented by axis z.

This is an example arrangement only, in which example sixteen tubes either side of the vertical midline (axis y) of the burner throat 22 deviate at least to some extent from the vertical. The burner set tubes in the example are numbered from 16L to 16R with tubes 16L/16R outermost from the midline of the burner throat and tubes 1L/1R innermost. Tubes that do not deviate from the vertical are labelled ST.

The throat is defined by a throat wall comprising elongate perimeter extending out of the plane of the furnace wall structure away from the outlet therein on the combustion side. Vertical tubes most closely in the vicinity of the burner throat pass into the throat around the throat wall. In the example illustrated, a throat perimeter wall comprises a cylindrical portion 25 distal to the outlet on the combustion side and a flared portion 26 proximal to the outlet on the combustion side, which has a flare angle $\alpha$ which in the example is 20 degrees. As is a typical design, the throat 22 is partly lined by the liner 23 to protect the portion of the throat distal to the outlet on the combustion side. The primary purpose of the liner 23 is to protect the portion of the throat from erosion; as a secondary consequence it also shields the area from full exposure to thermal radiation. As a compromise between protection and avoidance of fouling by slagging, this liner does not extend the full depth of the throat. In the example, the parallel region is lined and the flared section is not as the flared section is not exposed to such risk of erosion during use. Such arrangements of partial lining are common.

In other possible burner throat configurations, for example for the throats of burners that operate without high velocity pulverised coal stream close to the tubes, a liner may not be required. However part of the throat tube region is still to some extent shielded from the radiation by the burner components.

This invention is still applicable to all burner designs that inherently lead to two tube conditions where some tubes pass into and around a perimeter wall of the throat in a manner essentially fully exposed to thermal radiation in the throat, and where some tubes pass into and around a perimeter wall of the throat in a manner subject to reduced exposure to thermal radiation in the throat, whether by the presence of a throat shield in a shielded portion or otherwise.

The effect of this differential exposure is that tubes making up a vertical steam generator having a throat design of the general type illustrated can be grouped into four basic types by structure and thermal environment, in order towards the midpoint of a burner throat:

a) vertical tubes on the furnace wall away from the burner throat that carry vertical load and experience standard thermal conditions;

b) tubes in the vicinity of the burner throat that deviate from vertical but remain entirely on the furnace wall;

c) tubes that pass into and around a perimeter wall of the throat in the portion fully exposed to thermal radiation in the throat for example being in an unshielded region;

d) tubes that pass into and around a perimeter wall of the throat in the portion subject to reduced exposure to thermal radiation in the throat, for example being in a shielded region.

Vertical furnace straight tubes a) carry load and experience standard thermal conditions. Of the tubes b) to d) making up the burner set, it is those in group c) that are most exposed to the combined effects of pressure drop and thermal exposure to the flame. These tubes may be called "burner hot tubes" as they are likely hotter than all other furnace tubes as a result of picking up more heat and having a higher pressure drop. Tubes d) are in the burner throat but generally shielded from the flame radiation although they are still longer than the furnace straight tubes. Tubes b) deviate from straight but to a lesser extent still experience generally standard thermal conditions.

In the example of FIG. 1 it appears that the burner set tubes 13L to 8L and 8R to 13R are burner hot tubes while the burner set tubes no. 7L to 7R are hidden away from the flame radiation by the liner 23 although they are still longer than the furnace straight tubes. Tubes 16L to 14L and 14R to 16R are set entirely on the inner furnace wall and deviate only a little. Tubes ST do not deviate.

Normally all the burner throats in a given furnace wall will have an identical configuration and are arranged in line both horizontally and vertically. This is generally considered to be an important design feature from a mechanical perspective as the tubes b) to d) are ineffective at transferring vertical load. The tubes a) essentially carry the entire load and their proportion should be maximised. This favours vertical alignment of successive sets of burner throat.

As a result, the burner hot tubes will be repeated vertically and therefore during use may get much hotter than the other tubes due to the repeats of increases in both heat absorptions and pressure drops. The flow response of the burner hot tubes may also deteriorate due to the much higher friction losses caused by higher specific volume and longer flow paths. Mitigating this effect has become a critical issue in vertical tube furnace design.

SUMMARY

A possible solution, exemplified in Japanese patent publication 10-026305, is to shift the position of individual tubes disposed near a burner throat so that they have a varied position relative to the burner throat at different vertical stages. This is intended to give a more even heat exposure. The design ensures that a vertical alignment of successive sets of burner throat can be maintained, with the perceived mechanical advantage that the proportion of tubes on the furnace wall away from the burner throat that can carry vertical load is generally maintained. However it requires more complex tube arrangements and plural throat designs, and this can increase fabrication complexity and in particular make an assembly process based on pre-fabrication of throat modules potentially more complex. It is generally desirable to simplify the furnace wall fabrication process by providing system that enables use of a single throat design.

According to the invention in a first aspect, a furnace tube arrangement for a vertical tube steam generator comprises:

a plurality of furnace tubes adapted for passage of an evaporatable flow medium disposed generally vertically to form a generally planar structure comprising a furnace wall, at least one burner throat let into the planar structure at each of at least two vertically spaced levels, each burner throat defined by a throat perimeter wall into and around which tubes in the vicinity of the burner throat pass in order to leave the burner throat open;

characterised in that the burner throats at the respective levels are so disposed in the planar structure that a vertical mid-line of at least one throat at a first level is laterally offset from a vertical mid line of a corresponding throat at a second level.

In this way, the harsh thermal regime experienced by burner hot tubes essentially fully exposed to thermal radiation at the first level may be mitigated in that in consequence of this offset they may be located in a portion of the throat at the second level that is subject to reduced exposure to thermal radiation.

The invention lies in the provision of a lateral offset between a throat at one level and a corresponding throat (which is to say, a throat which lies most directly above it) at another level. The throat may be offset against a corresponding throat at an adjacent level (that is, the throat most immediately above it or below it) or, in the case where throats are provided at several levels, against a corresponding throat at any other level.

The invention may be embodied by any offset between any burner throats at different levels. Preferably multiple burner throats are provided laterally offset from a vertical mid line of a corresponding throat at a second level. Most preferably each burner throat at a given level is laterally offset from a vertical mid line of a corresponding throat at a second level, for example with all burner throats at the first level laterally offset from a vertical mid line of a corresponding throat at a second level in regular and identical manner. However the invention encompasses any pattern of offset arrangements whereby a throat at one level is laterally offset from a corresponding throat at any other level.

The effect may be achieved by means of this lateral offset alone, allowing a single design of burner throat, and thus offering advantages in terms of simplicity of design and fabrication of a vertical tube furnace wall.

Given a typical tube design in a typical vertical tube furnace wall burner throat, it has been found that the offset need not be that great, and the resultant loss of some further tubes from the group that are essentially vertical for the whole wall height and essentially carry the entire load can be minimized.

In particular, it has been noted that in a typical tube arrangement in a burner throat each burner throat may be configured such that some tubes pass into and around a perimeter wall of the throat in a portion of the throat essentially fully exposed to thermal radiation in the throat in use, and some tubes pass into and around a perimeter wall of the throat in a portion of the throat subject to reduced exposure to thermal radiation in the throat in use such as to define three groups of furnace tubes respectively:

a) tubes disposed entirely along the planar wall;

b) tubes that pass out of the plane of the structure and into and around the throat wall in the fully exposed portion;

c) tubes that pass out of the plane of the structure and into and around the throat wall in the portion subject to reduced exposure.

The invention may then be characterised in that, preferably as a consequence of the offset alone, the furnace tubes are so arranged as between a first burner throat at a first level and a corresponding second burner throat at a second level that at least some of the furnace tubes disposed such as to constitute tubes in group b) at said first level, and preferably all of the furnace tubes disposed such as to constitute tubes in group b) at said first level, are disposed such as to constitute tubes not in group b) at said second level.

Where such an arrangement of fully exposed tubes and tubes subject to reduced exposure is present, it is sufficient to introduce an offset that is merely enough to shift at least the most severely fully exposed tubes from one level to a position of reduced exposure at a second level. Such an offset, alone, may be sufficient to mitigate hot tube effects. In particular, complex rearrangement of tubes between levels need not be employed. All tubes may simply be disposed vertically on a furnace wall between levels. A single throat design with a single tube arrangement may be employed for all throats.

The invention in this preferred case relies upon the principle that in a given typical throat some tubes are fully exposed to the harsh thermal conditions (the "burner hot tubes") and some are not. For example, tubes in a part of the throat wall proximal to its outlet in the furnace wall are essentially fully exposed to thermal radiation in the throat in use and tubes in a part of the throat wall distal of its outlet in the furnace wall are subject to reduced exposure to thermal radiation in the throat in use. Thus the tubes in group (b) as above defined are comprised by tubes proximal the outlet in the furnace wall and the tubes in group (c) as above defined are comprised by tubes distal the outlet in the furnace wall.

This differential exposure may be attributable to various aspects of burner geometry. In a particular preferred case, a throat shield may shield part of the throat area, the portion of the throat essentially fully exposed to thermal radiation being the unshielded portion, and the portion of the throat subject to reduced exposure to thermal radiation in the throat being the shielded portion. The tubes in group (b) as above defined are then comprised by unshielded tubes and the tubes in group (c) as above defined are then comprised by shielded tubes. For example, the throat is provided with a throat shield disposed to shield furnace tubes in a part of the throat wall distal of its outlet in the furnace wall and to expose furnace tubes in a part of the throat wall proximal to its outlet in the furnace wall.

The invention thus relates to the arrangement of furnace tubes as they pass and progress in the vicinity of a first burner throat at a first level and a second burner throat at a second level. The arrangement of tubes disposed at least generally vertically and at least generally in parallel (except where they deviate to accommodate the burner throats) defines in use a vertical tube combustion chamber wall in familiar manner. In particular, a combustion chamber wall is defined by the provision of a plurality of generally parallel furnace tubes connected together in gas-tight manner by tube webs. Such an arrangement will be familiar.

The skilled person will appreciate that a reference herein to a vertical tube combustion chamber wall is understood in the art as being a reference to a class of combustion chamber wall in which a plurality of generally parallel furnace tubes rise from the bottom to the top in generally vertical orientation, to be distinguished in particular in this context from a spiral tube combustion chamber wall. Deviation from strict vertical orientation and strict parallel arrangement, particularly in the vicinity of the throat where this is an absolute necessity, does not exclude from the scope of the invention as it would be understood in the art.

In a typical prior art vertical tube combustion chamber wall structure, a plurality of burner throats will be let into the planar structure comprising the chamber wall in a transverse array around the perimeter of the wall at at least two vertically spaced levels (that is, at at least two heights). Thus, a typical combustion chamber wall structure comprises a plurality of throats around the perimeter of the combustion chamber at a plurality of levels.

At each burner throat, the furnace tube set in the vicinity deviates from the straight in order to accommodate the outlet, limiting its ability to carry a load. Only the straight furnace tubes which are not affected by passing in the vicinity of a throat are fully effective in transmitting a vertical load.

To avoid creating combustion chambers of excessive size, it is desirable to minimise the proportion of furnace tubes so affected, and accordingly in a standard design it is conventional to align throats at successive levels so as to maximise the number of furnace tubes which can be straight. However, this means that in a standard design the same tubes experience the harshest environment at successive levels, leading to the burner hot tube effect described above.

In accordance with the invention, this problem is mitigated in admirably simple manner. The structure is modified so that tubes comprising burner hot tubes subject to the harshest regime at one level are not subject to the harshest regime at another level. Instead, other tubes, which were not exposed to this harsh environment at the first level, are so exposed at the second level. This is achieved by means of a lateral offset between the or each throat at a first level and its corresponding throat at a second level.

However, to achieve this, it is not necessary to stagger the burner throats completely at successive levels. There may still at least be a substantial degree of overlap in a vertical direction between the burner throat at a first level (and in particular, the tube affected width associated with that burner throat at a first level) and the burner throat (and its tube affected width) at a second level. Only tubes which fall in category b) are affected by the most severe conditions at the first level, and only these are desirably otherwise located at the second level. A full throat width offset is not required.

The condition that at least the burner hot tubes subject to the most severe regime at the first level are otherwise located at the second level may be achieved by having some smaller degree of offset between a throat at the first level and a corresponding throat at the second level. That is to say, a vertical mid-line of a throat at a first level may be transversely (ie, horizontally) offset from a vertical mid line of a corresponding throat at a second level. However, the offset is much less than one throat width. Even if an offset alone is relied upon, it is only necessary to offset a burner throat at a first level and a corresponding burner throat at a second level by a transverse direction that is enough to ensure that burner hot tubes subject to the harshest regime (for example those forming group b) in the structure) at the first level are not subject to the harshest regime (for example being otherwise located in another group) at the second level. It follows that even if offset alone is relied upon, the offset need only be the width in a transverse direction of the tubes constituting group b), or looked at another way need only be the number of tube pitches corresponding to the number of tubes in group b). Indeed it may be that a smaller offset will be sufficient to give a degree of benefit. The radiation regime of tubes in group b) varies and some are hotter than others. Even a smaller offset that ensures that those tubes in group b) subject to the most severe regime at one level are subject to a less severe regime at another level may mitigate hot tube effects to some degree.

This can be illustrated by consideration of the shielded example of FIG. 1. By staggering the burner throats on the alternate burner rows for a few pitches, say seven pitches for the burner throats shown on FIG. 1, the fully exposed burner hot tubes of the first level would become either furnace straight tubes or shielded tubes in the burner throats on the next level. This would significantly reduce the total heat absorption of the burner hot tubes and/or shorten their flow paths. As a consequence, the temperature excess experienced by the burner hot tubes would be mitigated.

It is suggested that the burners on alternate rows should still be arranged in line to minimize the impact on the load carrying capacities of the relevant furnace walls as the set tubes forming the burner throats are unable to carry weight.

Arrangements in which the burner tubes themselves are rearranged between alternate levels by provision of alternate throat designs could be complex, and might in particular involve burner tubes passing over or around one another. A virtue of a simple offset such as proposed by the present invention is that the burner tubes can lie alongside each other. In a preferred case, all burner tubes are so disposed. It is also likely to be cost-effective if all burner throats have the same configuration. In a preferred case, the characterising feature of the invention is achieved in that a burner throat at a first level is offset in a horizontal direction from the burner throat at a second level by a sufficient degree of offset to achieve the required effect, and is for example offset by sufficient tube pitches, but preferably by no more than sufficient tube pitches, to ensure that tubes comprising group b) at the first level are positioned to comprise tubes not in group b) at the second level.

In a preferred case, a burner throat at a first level, or least the tube arrangement thereof, is identical to its corresponding burner throat at a second level. In a preferred case, the burner throats making up a perimeter series of burner throats at a given level, or at least the tube arrangements thereof, are identical. In a most preferred case, all the burner throats making up a furnace wall, or at least the tube arrangements thereof, are identical.

Preferably, the furnace tubes are cylindrical, and in particular comprise a cylindrical perimeter wall and a cylindrical internal bore adapted for passage of an evaporatable flow medium.

A plurality of generally parallel longitudinal disposed furnace tubes may be connected together in gas-tight manner by tube webs to define a combustion chamber wall.

The plural furnace tubes making up a combustion chamber wall may have identical size and/or shape and/or material composition, and in particular for example may be evenly pitched and/or separated by even widths of web. However, the invention is not limited to such an arrangement. It is known in the art for example to vary pitch, web width, and tube size and especially bore size to accommodate different thermal conditions, and the present invention is equally applicable to combustion chambers having such more complex arrangements of furnace tube.

The furnace tubes may comprise smooth tubes having a smooth inner surface. However, in accordance with a preferred embodiment of the invention, internally ribbed tubes are used.

In use, the surface of the tube and the surface of the web to which the tube is adjacent together form a portion of the combustion chamber wall which serves as a heat transfer surface to the flow medium within the tube. In a possible arrangement, additional heat transfer surfaces may be provided in the form of longitudinal fins on the outer surface of the tube wall.

Typically, the evaporatable flow medium is water/steam.

In a more complete aspect of the invention, a steam generator comprises a combustion chamber having a polygonal cross-section defined by a plurality of connected combustion chamber walls at least one of which has a furnace tube arrangement as hereinbefore described.

In a usual arrangement, the furnace tubes are disposed vertically in a vertically orientated furnace wall for the upward passage of an evaporatable flow medium.

In a preferred arrangement, the combustion chamber has a substantially rectangular cross-section with planar combustion chamber walls extending to substantially orthogonal corners.

In a preferred arrangement, the steam generator is a once-through generator in that the furnace tubes are disposed such that in normal continuous flow operation a single pass of the flow medium in the tubes leads to substantially complete evaporation.

In a preferred arrangement, the steam generator is a supercritical steam generator adapted for operation at supercritical conditions.

Supercritical steam generators (also known as Benson boilers) are frequently used for the production of electric power. They operate at "supercritical pressure". In contrast to a "subcritical boiler", a supercritical steam generator operates at such a high pressure (over 3,200 psi/22.06 MPa or 220.6 bar) that actual boiling ceases to occur, and the boiler has no water—steam separation. There is no generation of steam bubbles within the water, because the pressure is above the "critical pressure" at which steam bubbles can form. It passes below the critical point as it does work in the high pressure turbine and enters the generator's condenser. This is more efficient, resulting in slightly less fuel use. The term "boiler" is used in the art on occasion for such apparatus but is not strictly appropriate for a supercritical pressure steam generator, as no "boiling" actually occurs in this device.

Normally modern supercritical steam generators operate at sliding pressure mode. The steam pressure reduces with the boiler output. It means that supercritical steam generators still operate at subcritical pressure when boiler loads are below certain level. Boiling process occurs at subcritical pressure.

As used herein, the concept of a "steam generator" should be considered to apply for both supercritical and subcritical pressures.

In a preferred arrangement, the steam generator is adapted for once-through operation. When a once through boiler operates at once through mode, water flows, without recirculation, sequentially through the economizer, furnace wall, evaporating and superheating tubes. Boiling or evaporating ceases to occur at supercritical pressure but boiling still occurs when a once through boiler operates at subcritical pressure. It is not necessary to ensure the evaporation completes at furnace wall outlet if the down stream heating surfaces are designed for wet operation. Normally the heating surfaces downstream primary SH would not design for wet mode.

In a particular preferred case, the steam generator is adapted for use in a thermal power plant in that it is provided with, and fired in use by, a plural array of burners for carbonaceous fossil fuels, which burners pass through the respective burner throats to fire the combustion chamber. Suitable fuels include solids and especially pulverized solids, liquids, emulsions and gases, Thus, in accordance with the most complete aspect of the invention, there is also provided a thermal power plant comprising at least one steam generator as above described fired by burners as above described, with suitable fuel supply means, and in fluid communication with suitable means to generate electrical power from the steam produced by the steam generator.

BRIEF DESCRIPTION OF THE DRAWINGS

The invention will now be described by way of example only with reference to FIGS. 1 to 3 of the accompanying drawings in which.

DETAILED DESCRIPTION

Figure 1A:
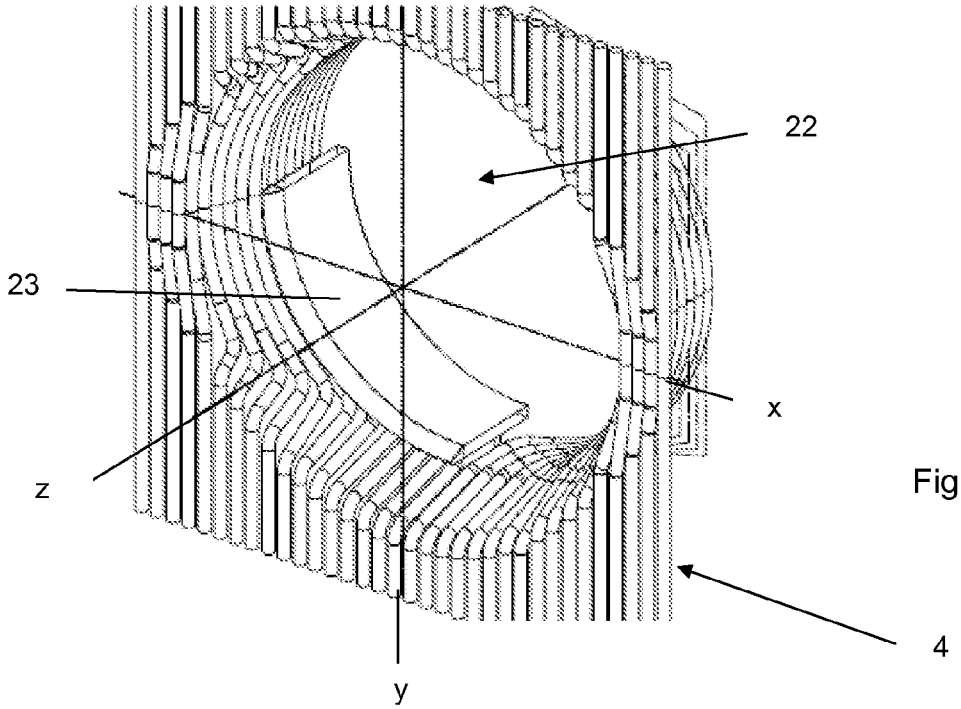
FIG. 1 is an illustration of a typical furnace tube arrangement at a burner throat as will be familiar from prior art systems, in perspective view (FIG. 1*a*) and in plan view (FIG. 1*b*)
Figure 1B:
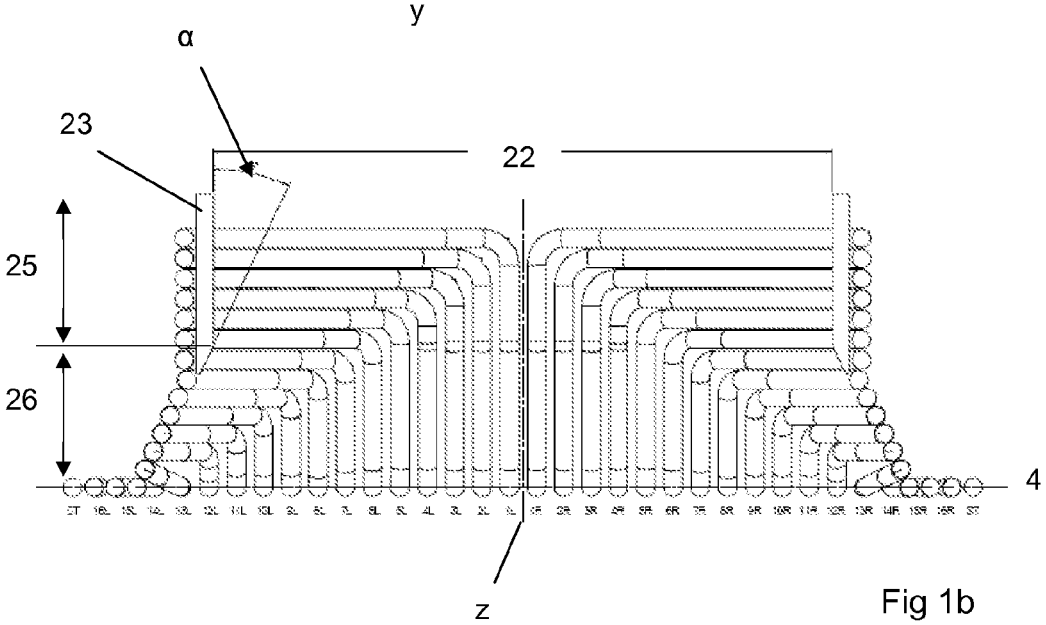

FIG. 1 has already been described in some detail in the discussion of the prior art. The most important point to appreciate in relation to the embodiment of the invention is that FIG. 1 illustrates that only some of the burner set tubes (in the representative example only 13L to 8L and 8R to 13R) experience the harshest conditions, being exposed on the interior of the throat perimeter wall without being covered by the shielding. These constitute what we have referred to as "burner hot tubes". Other tubes are carried on the throat perimeter wall but shielded.

Figure 2:
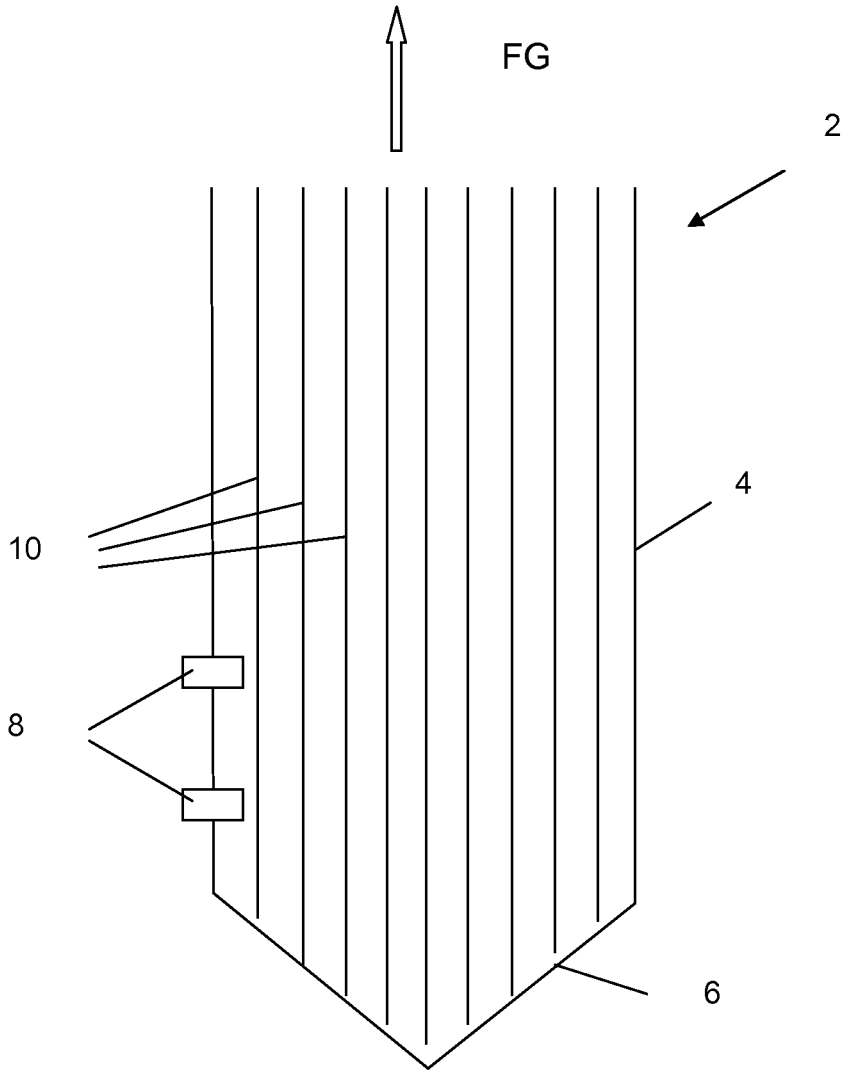
FIG. 2 is an illustration of a steam generation apparatus to which the invention can be applied.

FIG. 2 is general schematic illustration of a vertical tube steam generator to which the present invention can be applied. As represented in FIG. 2 there is seen a once-through steam generator 2 having a rectangular cross section and a vertical gas flue for the exit of flue gas (FG). A combustion chamber is defined by a combustion chamber wall 4 that merges at a lower end into a bottom wall 6 defining an area for the collection of solid combustion products. The combustion chamber is fired by burners 8. In the illustrated schematic in FIG. 2 only a pair of burners is shown, at a pair of levels, but in practice burners will extend around the perimeter of the combustion chamber wall 4, and may be disposed at several levels.

Each furnace wall is defined by a plurality of vertical furnace tubes 10, of which only a small number are shown for schematic purposes. Furnace straight tubes, which pass through areas of the furnace wall away from the vicinity affected by the burner throats, carry the majority of the vertical load. Furnace tubes in the vicinity of a burner throat deviate from the vertical to accommodate the burner throat and are not able to make a substantial contribution to the load bearing capacity of the boiler.

Each burner 8 is let into the combustion chamber via a burner throat in the combustion chamber wall 4 of the type which is illustrated in FIG. 1. When the combustion chamber is fired, the resultant burner flames create a particularly harsh environment for those tubes identified as burner hot tubes, with the attendant disadvantages described above.

Figure 3:
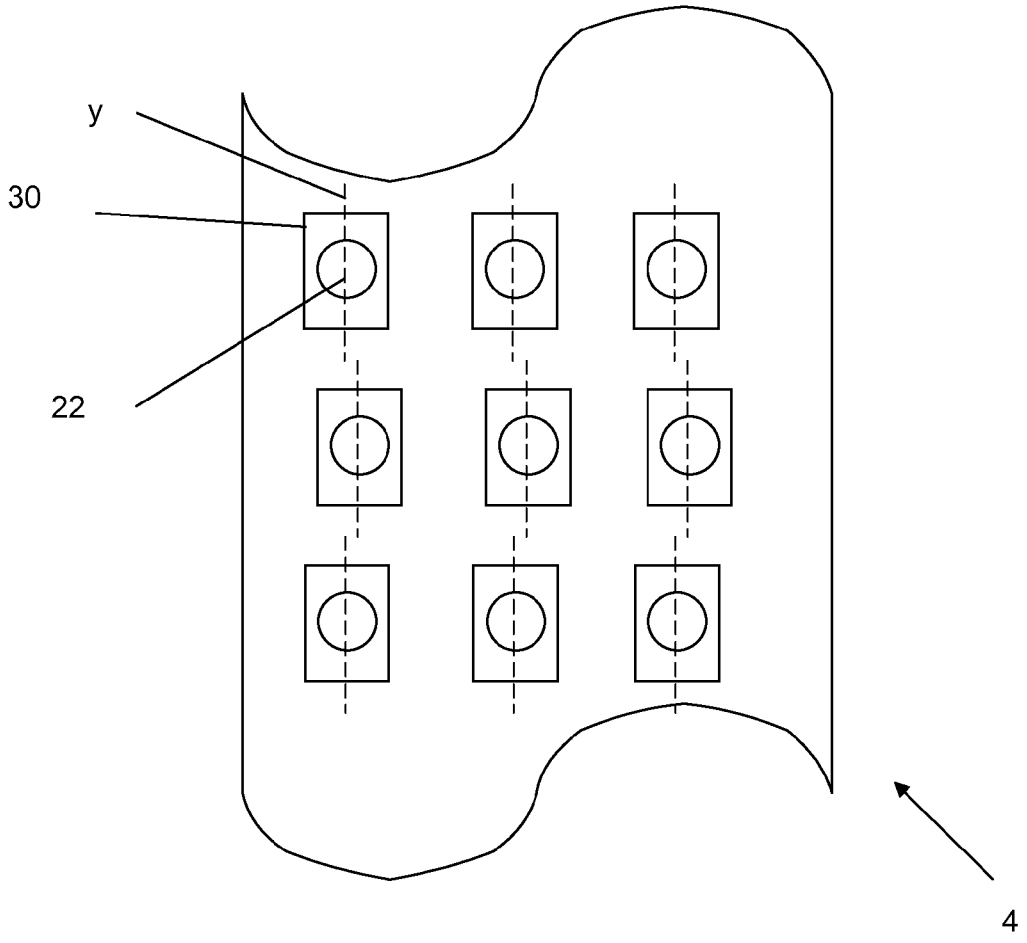
FIG. 3 is an illustration of a combustion chamber wall of the steam generation apparatus of FIG. 2, including burner throats disposed in accordance with the principles of the invention.

An embodiment in accordance with the present invention by means of which those attendant disadvantages are mitigated as illustrated in FIG. 3. In FIG. 3, a section of furnace wall 4 is shown in side elevation.

The furnace wall of FIG. 3 has burner throats at three levels. Each burner throat 22 has been provided with an indication of a vertical midline, axis y, and an indication of the area of the furnace wall where tubes are affected (by deviating from pure vertical orientation), being represented schematically by the rectangle 30.

In the illustrated embodiment, burner throats at the lowest and highest level are exactly aligned (that is their mid lines are aligned vertically) as would be familiar from a typical prior art design. However, all burner throats at the second level are laterally offset. This is merely an example arrangement. The invention is not limited to an arrangement to offset between burner throats at adjacent levels, nor to an arrangement to offset all burner throats at a given level, whether systematically or otherwise. A suitable offset between any throat at any level and a corresponding throat at another level may give benefit.

The lateral offset of the burner throats at the second level is by considerably less than a single throat width. Instead, in accordance with the principles of the invention, it constitutes just sufficient offset to cause the burner hot tubes at the first level to be otherwise positioned at the second level. Considering FIG. 1*a*, it could be seen for instance that an offset of a few pitches, in the specific example of FIG. 1*a* just seven pitches, would be sufficient to produce this effect. Given a seven pitch offset in the illustrated example, hot tubes 13L to 8L at first level would find themselves out of the burner throat and on the furnace wall itself at the second level and hot tubes 8R to 13R from the first level would find themselves as hidden tubes shielded by the shield at the second level. Likewise, those tubes which did constitute fully exposed hot tubes at the second level would similarly either have been shielded tubes, or furnace wall tubes, at the corresponding first level.

Thus, in accordance with the arrangement illustrated in FIG. 3, no furnace tube is in a hot tube position at successive levels. Nevertheless, this effect has been achieved with a relatively small horizontal offset, constituting much less than one throat width, and indeed less than half of one semi-width of the throat affected zone (the zone where tubes deviate from the vertical). In the illustrated example, a semi-width of the throat affected zone comprises sixteen tube pitches, and an offset of just seven is sufficient to produce the effect of the invention.

This is merely an example arrangement. Even as between tubes exposed in a hot tube position the temperature regime may vary. It follows that even a smaller offset that ensures that those exposed hot tubes subject to the most severe regime at one level are subject to a less severe regime at another level may mitigate hot tube effects to some degree.

Thus, a significant mitigation of the hot tube effect is achieved without a significant offset being required, and consequently without excessive increase in the total number of tubes which are not fully straight. A significant mitigation of the hot tube effect can be achieved without significantly increasing furnace size.

In the illustrated embodiment, burners on alternate rows are still arranged in line vertically. This, together with the relatively small offset, minimizes the impact on the proportion of tubes which remain fully vertical and have a full load carrying capability.

Moreover, the mitigation of the hot tube effect is achieved by virtue of a small horizontal offset alone without increasing the complexity of the throat designs. A single throat design is used. All burner throats have the same tube configuration. Burner tubes lie alongside each other. Complex reordering of tubes is not required. All tubes lie vertical and parallel on the wall between levels. The offset alone produces mitigation of the hot tube effect.

Alternative designs of burner throat, and in particular alternative arrangements of furnace tube within a burner throat, could be envisaged which would complement or supplement the effect of an offset without departing from the general principles of the invention. However, it is a particular advantage of the invention that burner throat designs, and in particular furnace tube arrangements in the burner throat, may be identical in a given combustion chamber, and may be entirely conventional.

The illustrative embodiment of FIG. 3 is discussed with reference to an example burner throat design such as shown in FIG. 1. The throat carries a throat shield as a result of which only some of the burner set tubes carried on the throat perimeter wall experience the harshest conditions. Other tubes are carried on the throat perimeter wall but shielded. This inherently leads to two tube conditions where some tubes pass into and around a perimeter wall of the throat in a manner essentially fully exposed to thermal radiation in the throat, and where some tubes pass into and around a perimeter wall of the throat in a manner subject to reduced exposure to thermal radiation in the throat. It will be appreciated that both the illustrative embodiment of FIG. 3, and the invention generally, may be applied in all cases where the burner geometry creates this condition, whether by the presence of a throat shield in a shielded portion or otherwise.

The invention claimed is:

1. A furnace tube arrangement for a vertical tube steam generator comprising:

a plurality of furnace tubes adapted for passage of an evaporatable flow medium disposed generally vertically to form a generally planar structure;

at least one burner throat let into the planar structure at at least two vertically spaced levels, each burner throat defined by a throat wall into and around which tubes in the vicinity of the burner throat pass in order to leave the burner throat open;

wherein the burner throats at the respective levels are so disposed that a vertical mid-line of a throat at a first level is laterally offset from a vertical mid line of a corresponding throat at a second level, wherein each burner throat is configured such that some tubes pass into and around a perimeter wall of the throat in a portion of the throat essentially fully exposed to thermal radiation in the throat in use, and some tubes pass into and around a perimeter wall of the throat in a portion of the throat subject to reduced exposure thermal radiation in the throat in use;

such as to define three groups of furnace tubes respectively:

a) tubes disposed entirely along the planar wall;

b) tubes that pass out of the plane of the structure and into and around the throat wall in the exposed portion;

c) tubes that pass out of the plane of the structure and into and around the throat wall in the shielded portion;

and wherein the furnace tubes are so arranged as between a first burner throat at a first level and a corresponding second burner throat at a second level that at least some of the furnace tubes disposed such as to constitute tubes in group b) at said first level are disposed such as to constitute tubes not in group b) at said second level.

2. A furnace tube arrangement in accordance with claim 1, wherein the lateral offset between a vertical mid-line of the or each throat at a first level and a vertical mid line of a corresponding throat at a second level is such that at least some of the furnace tubes disposed such as to constitute tubes in group b) at the or each throat at the first level are located such as to constitute tubes not in group b) in a corresponding throat at said second level.

3. A furnace tube arrangement in accordance with 2 wherein the throat is configured such that tubes in a part of the throat wall proximal to its outlet in the furnace wall are essentially fully exposed to thermal radiation in the throat in use and tubes in a part of the throat wall distal of its outlet in the furnace wall are subject to reduced exposure to thermal radiation in the throat in use.

4. A furnace tube arrangement in accordance with claim 1 wherein the throat is provided with a throat shield disposed to shield part of the throat area, the portion of the throat essentially fully exposed to thermal radiation being the unshielded portion, and the portion of the throat subject to reduced exposure to thermal radiation in the throat being the shielded portion.

5. A furnace tube arrangement in accordance with claim 4 wherein the throat shield is disposed to shield furnace tubes in a part of the throat wall distal of its outlet in the furnace wall and to expose furnace tubes in a part of the throat wall proximal to its outlet in the furnace wall.

6. A furnace tube arrangement in accordance with claim 1 comprising a plurality of generally parallel furnace tubes connected together in gas-tight manner by tube webs to define a combustion chamber wall.

7. A furnace tube arrangement in accordance with claim 6 wherein a plurality of combustion chamber walls are disposed to define a combustion chamber.

8. A furnace tube arrangement in accordance with claim 7 comprising a plurality of burner throats around the perimeter of the combustion chamber at a plurality of levels.

9. A furnace tube arrangement in accordance with claim 1 wherein a vertical mid-line of a throat at a first level is horizontally offset from a vertical mid line of a corresponding throat at a second level by less than one throat width.

10. A furnace tube arrangement in accordance with claim 9 wherein a vertical mid-line of a throat at a first level is horizontally offset from a vertical mid line of a corresponding throat at a second level by a sufficient offset that at least some of the furnace tubes forming group b) in the structure at the first level are otherwise located in another group at the second level.

11. A furnace tube arrangement in accordance with claim 10 wherein a longitudinal mid-line of a throat at a first level is laterally offset from a longitudinal mid line of a corresponding throat at a second level by an offset substantially equal to that of the number of tube pitches corresponding to the number of tubes in group b).

12. A furnace tube arrangement in accordance with claim 1 wherein the furnace tubes are cylindrical, and in particular comprise a cylindrical perimeter wall and a cylindrical internal bore adapted for passage of an evaporatable flow medium.

13. A furnace tube arrangement in accordance with claim 1 wherein the furnace tubes have internally ribbed tube bores.

14. A steam generator comprising a combustion chamber having a polygonal cross-section defined by a plurality of connected combustion chamber walls at least one of which has a furnace tube arrangement comprising:

a plurality of furnace tubes adapted for passage of an evaporatable flow medium disposed generally vertically to form a generally planar structure;

at least one burner throat let into the planar structure at at least two vertically spaced levels, each burner throat defined by a throat wall into and around which tubes in the vicinity of the burner throat pass in order to leave the burner throat open;

wherein the burner throats at the respective levels are so disposed that a vertical mid-line of a throat at a first level is laterally offset from a vertical mid line of a corresponding throat at a second level, wherein each burner throat is configured such that some tubes pass into and around a perimeter wall of the throat in a portion of the throat essentially fully exposed to thermal radiation in the throat in use, and some tubes pass into and around a perimeter wall of the throat in a portion of the throat subject to reduced exposure to thermal radiation in the throat in use;

such as to define three groups of furnace tubes respectively:

a) tubes disposed entirely along the planar wall;

b) tubes that pass out of the plane of the structure and into and around the throat wall in the exposed portion;

c) tubes that pass out of the plane of the structure and into and around the throat wall in the shielded portion;

wherein the furnace tubes are so arranged as between a first burner throat at a first level and a corresponding second burner throat at a second level that at least some of the furnace tubes disposed such as to constitute tubes in group b) at said first level are disposed such as to constitute tubes not in group b) at said second level.

15. A steam generator in accordance with claim 14 wherein the furnace tubes are disposed vertically in a vertically orientated furnace wall for the upward passage of an evaporatable flow medium.

16. A steam generator in accordance with claim 14 wherein the combustion chamber has a rectangular cross-section with combustion chamber walls extending towards substantially orthogonal corners.

17. A steam generator in accordance with claim 14 arranged for once-through operation in that the furnace tubes are disposed such that in normal continuous flow operation a single pass of the flow medium in the tubes leads to substantially complete evaporation.

18. A steam generator in accordance with claim 14 adapted for use in a thermal power plant in that it is provided with, and fired in use by, a plural array of burners for carbonaceous fossil fuels, which burners pass through the respective burner throats to fire the combustion chamber.

19. A thermal power plant comprising at least one steam generator in accordance with claim 14 provided with burners to fire the combustion chamber thereof and fuel supply means to supply combustible fuel to the burners, and in fluid communication with suitable means to generate electrical power from the steam produced by the steam generator.

* * * * *